US010823345B2

(12) United States Patent
Wang et al.

(10) Patent No.: US 10,823,345 B2
(45) Date of Patent: Nov. 3, 2020

(54) DECORATIVE LED LIGHT STRING STRUCTURE AND ASSEMBLING METHOD THEREOF

(71) Applicants: An Wang, Zhejiang (CN); Rongji Mo, Zhejiang (CN); Xiaoyong Chen, Zhejiang (CN)

(72) Inventors: An Wang, Zhejiang (CN); Rongji Mo, Zhejiang (CN); Xiaoyong Chen, Zhejiang (CN)

(73) Assignee: Taizhou Jiaojiang Yingxing Electronic Co., Ltd., Taizhou (CN)

( * ) Notice: Subject to any disclaimer, the term of this patent is extended or adjusted under 35 U.S.C. 154(b) by 0 days.

(21) Appl. No.: 16/558,352

(22) Filed: Sep. 3, 2019

(65) Prior Publication Data

US 2020/0088362 A1 Mar. 19, 2020

(30) Foreign Application Priority Data

Sep. 18, 2018 (CN) ..... 2018 1 1088645

(51) Int. Cl.
*F21S 4/10* (2016.01)
*F21V 23/00* (2015.01)
(Continued)

(52) U.S. Cl.
CPC ..... *F21S 4/10* (2016.01); *F21V 23/004* (2013.01); *F21Y 2113/10* (2016.08); *F21Y 2115/10* (2016.08)

(58) Field of Classification Search
CPC ..... H05B 47/165; H05B 45/20; H05B 45/46; H05B 45/00; F21S 4/10; F21V 23/004; F21Y 2113/10; F21Y 2115/10
See application file for complete search history.

(56) References Cited

U.S. PATENT DOCUMENTS 7,928,667 B2 * 4/2011 Peng ..... H05B 45/37 315/294
8,567,992 B2 * 10/2013 Lo ..... H05B 45/48 362/249.05

(Continued)

FOREIGN PATENT DOCUMENTS

CN 1633047 A 6/2005
CN 1971922 A 5/2007

(Continued)

*Primary Examiner* — Borna Alaeddini

(74) *Attorney, Agent, or Firm* — Minder Law Group; Willy H. Wong

(57) ABSTRACT

A decorative LED light string structure comprises a plurality of LED light-emitting units, each of the units comprises an RGB light-emitting diode and a control IC, a common pin of the RGB light-emitting diode is connected to a positive power terminal of the control IC, three electrode pins of the RGB light-emitting diode are respectively connected to three control terminals of the control IC correspondingly, one of the electrode pins of the RGB light-emitting diode is connected with a voltage amplifier circuit, an output terminal of the voltage amplifier circuit is connected to a write terminal of the control IC, and the LED light-emitting units are connected in series or in parallel through the positive and negative power terminals of the control ICs. A method for assembling a decorative LED light string comprising the following steps: assembling an LED light string; encoding and inputting address code; and forming address code.

3 Claims, 6 Drawing Sheets

(51) Int. Cl.
*F21Y 113/10* (2016.01)
*F21Y 115/10* (2016.01)

(56) References Cited

U.S. PATENT DOCUMENTS

| | | | | |
|---|---|---|---|---|
| 2001/0007360 | A1* | 7/2001 | Yoshida | H01L 25/0753 257/89 |
| 2004/0217718 | A1* | 11/2004 | Kumar | H05B 47/19 315/291 |
| 2004/0264184 | A1* | 12/2004 | Choi | H01L 25/0753 362/231 |
| 2007/0086185 | A1* | 4/2007 | Hwang | H01L 25/0753 362/231 |
| 2009/0289578 | A1* | 11/2009 | Peng | H05B 47/18 315/294 |
| 2012/0086349 | A1* | 4/2012 | Segan | H05B 45/00 315/187 |
| 2018/0084625 | A1* | 3/2018 | Niebert | H05B 45/00 |
| 2018/0235056 | A1* | 8/2018 | Johnson | H05B 47/175 |

FOREIGN PATENT DOCUMENTS

| | | | | |
|---|---|---|---|---|
| CN | 101140220 | A | 3/2008 | |
| CN | 201935022 | U | 8/2011 | |
| CN | 102904640 | A | 1/2013 | |
| CN | 205404444 | U | 7/2016 | |
| CN | 105955112 | A | 9/2016 | |
| CN | 107306463 | A | 10/2017 | |
| CN | 206918735 | U | 1/2018 | |
| CN | 108282919 | A | 7/2018 | |
| DE | 102008061089 | * | 6/2010 | H05B 47/19 |

* cited by examiner

DECORATIVE LED LIGHT STRING STRUCTURE AND ASSEMBLING METHOD THEREOF

RELATED APPLICATIONS

This application claims benefit of Chinese Patent Application No. CN201811088645.X filed Sep. 18, 2018.

The above applications and all patents, patent applications, articles, books, specifications, other publications, documents, and things referenced herein are hereby incorporated herein in their entirety for all purposes. To the extent of any inconsistency or conflict in the definition or use of a term between any of the incorporated publications, documents, or things and the text of the present document, the definition or use of the term in the present document shall prevail.

BACKGROUND OF THE INVENTION

Field of Invention

The present invention belongs to the technical field of pointwise controlled LED light strings, and relates to a decorative LED light string structure and an assembling method thereof.

Related Art

LED is known as light-emitting diode. When the LED is energized, it will emit light to illuminate the environment or objects. Because of its characteristics of energy-saving, diverse colors, and convenient to control, it is widely used in various lighting devices. According to the characteristics of the LED, people often connect the LEDs to form as a decorative light string to be applied in the fields of Christmas trees, interior decoration, outdoor decoration and the like.

At present, RGB light-emitting diodes capable of emitting red (R), green (G) and blue (B) colors are often used to form decorative LED light strings, and by controlling the on or off of each light-emitting diode of the light string, or colors of the LED, the light string can display patterns or texts, that is, performing the pointwise control of the LED lights. In order to pointwise control each LED of the LED light string, it is necessary to integrate and dispose a control IC on each LED, and set an address code in the control IC, and the LED is addressed by a main controller to perform control accordingly.

In the production of the decorative LED light string that can be pointwise controlled, it is necessary to input the address code into the control IC one by one in sequence, and then assemble with the corresponding LEDs in order, which will take a lot of time, and it takes even a longer time to correct the error if the positions of the control ICs are arranged mistakenly, so the assembly efficiency of the existing pointwise controlled decorative LED light strings is extremely low.

For this reason, the research and development personnel have conducted research to provide a new assembly method, such as a LED light-emitting light string and an array composed of a plurality of light strings, which is disclosed in Chinese patent application no. 201720226345.8. In the patent, when setting the address codes and manufacturing the integrated circuit, the conductor layer is directly used for connection with high and low electrical levels, or solder pads are lead out for wire connection during the LED packaging; or a fuse structure can be provided for the control ICs to be burnt and programmed before the LED packaging; or an EPRPM or EEPROM structure can be provided for the control ICs to be burnt and programmed during or after the LED packaging.

In the above patent, the address codes can be encoded after the control ICs are assembled with the LED lights, and the address codes can be encoded not according to the order, and then the LED lights are connected to form a light string after the address codes are encoded. Although the patent allows encoding after the control ICs are assembled with the LED lights, the time for inputting the address codes into the control ICs sequentially, and the time for finding the corresponding LEDs for the control ICs for assembly are saved; however, when inputting the address codes, it is required to perform connection at different electrical levels for the setting terminals of the control ICs, the connection takes a long time, and the encoding time is also long, so that not only the operation is troublesome, but also it is time consuming; at the same time, it is easy to make mistakes when burning and programming are performed after the packaging, the cost is relatively higher, and therefore the assembly efficiency of the pointwise controlled decorative LED lights is still not very high.

SUMMARY OF THE INVENTION

In view of the technical problems in the prior art, one embodiment of the present invention provides a decorative LED light string structure and an assembling method thereof. The technical problem solved by the decorative LED light string structure and the assembling method thereof is how to improve the assembly efficiency of the decorative LED light string.

The present invention is achieved by the following technical solutions: a decorative LED light string structure comprises a plurality of LED light-emitting units, each of the LED light-emitting units comprises an RGB light-emitting diode with one common pin and three electrode pins, and a control IC capable of storing an address code and capable of comparing address code signals. The control IC comprises a power supply terminal, a write terminal capable of writing address code information, and three control terminals capable of on and off control. The common pin of the RGB light-emitting diode is connected to the power supply terminal of the control IC, and the three electrode pins of the RGB light-emitting diode are respectively connected to the three control terminals correspondingly, wherein one of the electrode pins of the RGB light-emitting diode is connected with a voltage amplifier circuit, and an output terminal of the voltage amplifier circuit is connected to the write terminal, and the LED light-emitting units are connected to form a light string in series or parallel connection and are powered by the power supply terminals of the control ICs.

One embodiment of the decorative LED light string structure can be formed in the aforementioned connection manner by connecting any one of the control ICs not yet encoded with an address code together with any one of the RGB light-emitting diodes, and then perform packaging. Only a positive power terminal or a negative power terminal of the control IC are led outside of the package to form the independent LED light-emitting unit, and the LED light-emitting units are connected to each other through the positive power terminals and the negative power terminals of the control ICs to form the LED light string, and the connection manner can be in series or parallel. After the LED light string is connected, optical encoding signals are sent to the RGB light-emitting diodes, and the inputted optical encoding signals are amplified and output to the control ICs by the voltage amplifier circuit to complete the encoding of the address codes. Since inputting of the address codes is not required when assembling the LED light string, an operator can arbitrarily select the address code and the RGB light-emitting diode for assembly, thereby greatly improving the assembly efficiency of the LED light-emitting units. Only the positive power terminals and the negative power terminals of the control ICs of the LED light-emitting units are led outside of the package, and the LED light-emitting units can be quickly connected to each other to form the LED light string to further enhance the assembly efficiency. By disposing the voltage amplifier circuit, the control ICs in the LED light string can sense the optical encoding signals received by the RGB light-emitting diodes, thereby the address codes can be inputted quickly, and by disposing the voltage amplifier circuit, assembly of the LED string without first writing the address code is an ensured success.

In one embodiment of the above-mentioned decorative LED light string structure, a resistor R1 capable of forming a voltage signal is disposed between the voltage amplifier circuit and the electrode pin of the RGB light-emitting diode connected to the voltage amplifier circuit, a first end of the resistor R1 is connected to an input terminal of the voltage amplifier circuit, and a second end of the resistor R1 is connected to the aforementioned electrode pin of the RGB light-emitting diode. When the RGB light-emitting diode receives the optical encoding signal to generate a micro current, the generated micro current flows through the resistor R1 to generate a corresponding voltage signal, and the voltage signal is amplified by the voltage amplifier circuit and the amplified voltage signal is inputted into the control IC. The RGB light-emitting diode being used is the RGB light-emitting diode which is commonly used in the market. In the code writing state, the light-emitting diode is irradiated by an encoding glare emitted by an encoder, and the weak photoelectric effect is used to input and write the codes; and in the non-code writing state, the light-emitting diode is used in a normal state to emit light to perform various flickering patterns, and it is not necessary to use a special or dedicated photoelectric receiver to control conversion.

In one embodiment of the above-mentioned decorative LED light string structure, each RGB light-emitting diode is composed of an R light-emitting diode emitting red light, a G light-emitting diode emitting green light, and a B light-emitting diode emitting blue light, a positive terminal of the R light-emitting diode, a positive terminal of the G light-emitting diode, and a positive terminal of the B light-emitting diode are connected to form the common pin of the RGB light-emitting diode, the common pin is connected with a resistor R2 capable of current limiting, and the positive power terminal of the control IC is connected to the common pin of the RGB light-emitting diode through the resistor R2. The common positive terminal of the R light-emitting diode, the G light-emitting diode and the B light-emitting diode is connected to the positive power terminal of the control IC through the resistor R2, and the resistor R2 limits the current of the control IC outputted to the RGB light-emitting diode to avoid the RGB light-emitting diode from being damaged by overcurrent. In one embodiment of the above-mentioned decorative LED light string structure, the LED light-emitting units are sequentially arranged, the negative power terminal of the control IC of the first LED light-emitting unit is connected to the positive power terminal of the control IC of the second LED light-emitting unit to form the LED light-emitting units connected in series, and a voltage regulation module is connected between the positive power terminal in the control IC and the negative power terminal of the same control IC. Through the above connections, the LED light-emitting units are connected in series, and the voltage inputted to each of the LED light-emitting units is regulated by disposing the voltage regulation module to maintain the normal operation of each of the LED light-emitting units.

In one embodiment of the above-mentioned decorative LED light string structure, the decorative LED light string structure further comprises a power supply unit, an electronic switch, and a main controller capable of controlling an on-off frequency of the electronic switch, the electronic switch is respectively connected to the power supply unit and the main controller, the positive power terminal of the control IC of the first LED light-emitting unit of the LED light-emitting units in series connection is connected to a current output terminal of the electronic switch, the negative power terminal of the control IC of the last LED light-emitting unit of the LED light-emitting units in series connection is connected to a current input terminal of the electronic switch, and a capacitor C1 capable of charging and discharging is connected between the positive power terminal in the control IC and the negative power terminal of the same control IC. The main controller controls the on-off frequency of the electronic switch so that the electronic switch outputs different electrical signals to the respective control ICs, thereby addressing the address codes of the control ICs. When the electronic switch is in a conducting state, the capacitor C1 is charged, and the capacitor C1 is discharged to supply electric power for the control IC when the electronic switch is disconnected, thereby the control IC can be powered continuously to operate when the main controller controls the electronic switch to be turned on and off.

In one embodiment of the above-mentioned decorative LED light string structure, the LED light-emitting units are sequentially arranged, the positive power terminal of the control IC of each of the LED light-emitting units are connected and the negative power terminal of the control IC of each of the LED light-emitting units are connected to form the LED light-emitting units connected in parallel. By connecting the LED light-emitting units in parallel, the input voltage requirements can be smaller, and the LED light-emitting units operate relatively stably to satisfy the relevant control of the decorative LED light string.

In one embodiment of the above-mentioned decorative LED light string structure, the decorative LED light string structure further comprises the power supply unit, the electronic switch, and the main controller capable of controlling an on-off frequency of the electronic switch, the electronic switch is respectively connected to the power supply unit and the main controller, the positive power terminal of the control IC of each of the LED light-emitting units of the LED light-emitting units in parallel connection is connected to the current output terminal of the electronic switch, the negative power terminal of the control IC of each of the LED light-emitting units of the LED light-emitting units in parallel connection is connected to the current input terminal of the electronic switch, the positive power terminal of each of the control ICs is connected with a diode D1 and a capacitor C2 capable of charging and discharging, one end of the capacitor C2 is respectively connected to the current output terminal of the electronic switch and the positive power terminal of the corresponding control IC, and another end of the capacitor C2 is connected to a positive terminal of the diode D1, and a negative terminal of the diode D1 is connected to the current input terminal of the electronic switch. The main controller controls the on-off frequency of the electronic switch so that the electronic switch outputs different electrical signals to the respective control ICs, thereby addressing the address codes of the control ICs. When the electronic switch is in a conducting state, the capacitor C2 is charged, and the capacitor C2 is discharged to supply electric power for the control IC when the electronic switch is disconnected, thereby the control IC can be powered continuously to operate when the main controller controls the electronic switch to be turned on and off, and the capacitor C2 is ensured to discharge normally by disposing the diode D1.

A method for assembling a decorative LED light string comprising the following steps:

A. assembling an LED light string: connecting and assembling a control IC not yet encoded with an address code together with an RGB light-emitting diode, connecting an electrode pin of the RGB light-emitting diode with a voltage amplifier circuit, connecting an output terminal of the voltage amplifier circuit with a write terminal of the control IC, packaging the control IC, the RGB light-emitting diode, and the voltage amplifier circuit to form the LED light-emitting unit, and connecting a plurality of LED light-emitting units in series or in parallel to form the LED light string;

B. encoding and inputting address code: using a glare encoding device to irradiate the RGB light-emitting diode of each of the LED light-emitting units with illumination of different frequencies, and inputting an optical encoding signal; and C. forming address code: having the RGB light-emitting diode generate a corresponding periodical micro current according to the inputted optical encoding signal, having the generated micro current flow through the resistor R1 to generate a voltage signal, amplifying the voltage signal by the voltage amplifier circuit and inputting the amplified voltage signal into the control IC, and having the control IC generate a corresponding address code according to a period of the voltage signal.

In one embodiment of the method for assembling the decorative LED light string, the control ICs with a blank address code (not yet encoded with an address code) are adopted during the assembly of the LED light string, so that the control ICs are not required to be assembled in a specific order based on the address codes, and there is no need to find the corresponding RGB light-emitting diodes, and therefore the operator can arbitrarily select the address code and the RGB light-emitting diode for assembly, thereby greatly improving the assembly efficiency of the LED light-emitting units. Only the positive power terminals and the negative power terminals of the control ICs of the LED light-emitting units are led outside of the package, and the LED light-emitting units can be quickly connected to each other to form the LED light string to further enhance the assembly efficiency. After completing the assembly of the LED light string, the optical encoding signals are inputted to the RGB light-emitting diodes by using the glare encoding device. By disposing the voltage amplifier circuit, the control ICs in the LED light string can sense the optical encoding signals received by the RGB light-emitting diodes, thereby the address codes can be inputted quickly, and by disposing the voltage amplifier circuit, assembly of the LED string without first writing the address code is an ensured success.

In one embodiment of the above-mentioned method for assembling the decorative LED light string, in step C, after the address code is formed, the control IC outputs a voltage to control the RGB light-emitting diode connected to the control IC to turn on a corresponding light. After inputting an address code, the control IC controls the RGB light-emitting diode to turn on to remind the operator that the address code input has been completed, so that the operator does not need to perform verification again, thereby improving the encoding speed, and thus improving the assembly efficiency of the decorative LED light string.

In one embodiment of the above-mentioned method for assembling the decorative LED light string, the glare encoding device comprises a glare encoder and an encoding LED that is controlled by the glare encoder to turn on illumination of different frequencies, and the optical encoding signal is inputted through irradiating the RGB light-emitting diode by the encoding LED. Through the above operation, the glare encoding device can be hand-held to perform encoding to enhance the convenience and efficiency of encoding, and therefore the final step of assembling the decorative LED light string can be quickly completed.

Compared to the prior art, one embodiment of the decorative LED light string structure and the assembling method thereof have the following advantages:

1. The present invention does not need to consider inputting of the address codes in the process of assembling into the LED light string, so that the control ICs and the RGB light-emitting diodes can be arbitrarily selected for assembling, thereby greatly improving the assembly efficiency of the LED light-emitting units.

2. The present invention can enable the control ICs in the LED light string to sense the optical encoding signals received by the RGB light-emitting diodes by disposing the voltage amplifier circuit, thereby the address codes can be inputted quickly, and by disposing the voltage amplifier circuit, assembly of the LED string without first writing the address code is an ensured success.

DETAILED DESCRIPTION OF THE INVENTION

The technical solutions of the present invention are further described below with reference to the specific embodiments of the present invention in conjunction with the accompanied drawings, but the present invention is not limited to the embodiments.

Embodiment 1

Figure 1:
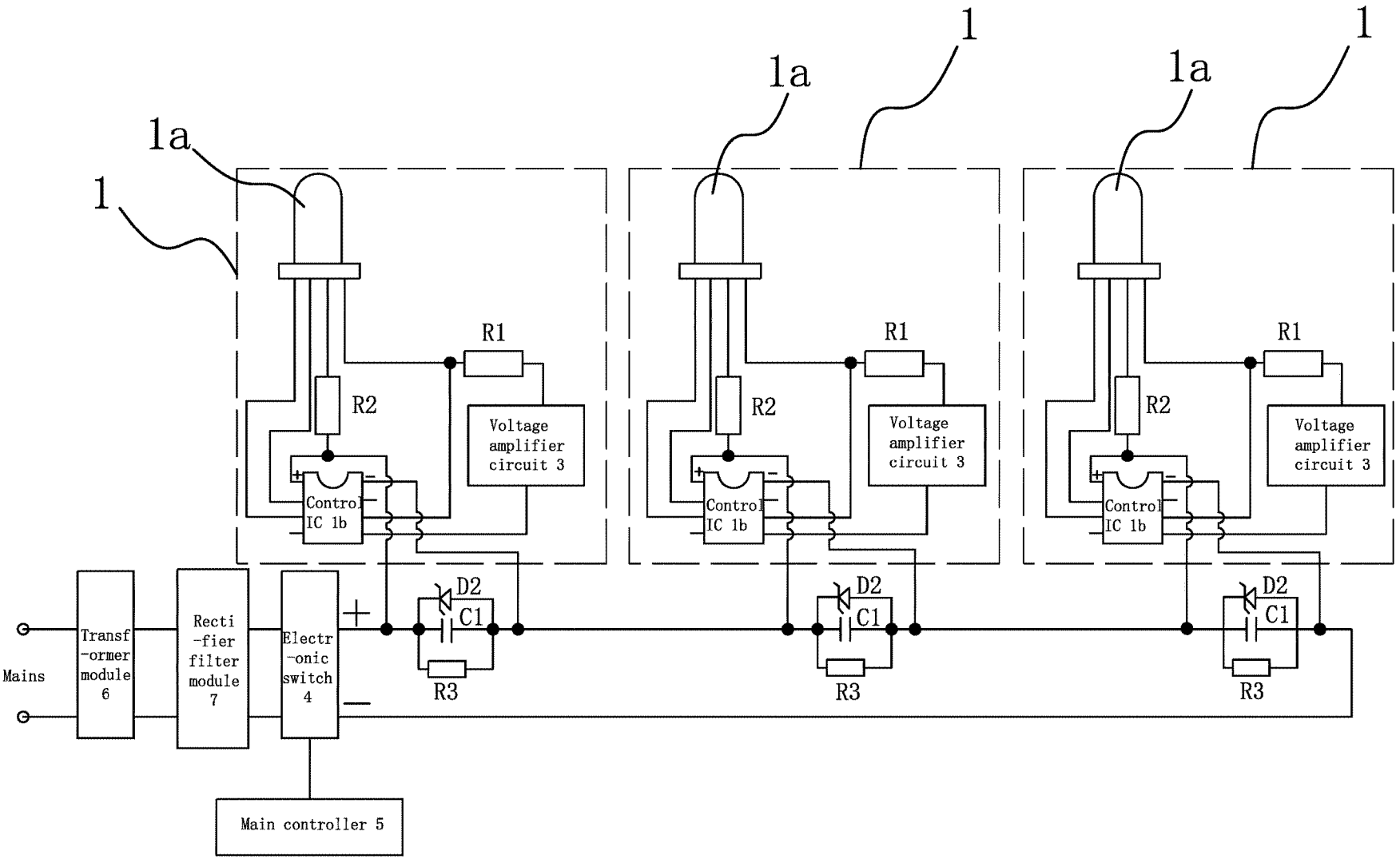
FIG. 1 is a schematic diagram of the structure of one embodiment of an LED light string formed by connecting LED light-emitting units of the present invention in series.

In FIG. 1, three LED light-emitting units 1 are used as an example, a quantity of the LED light-emitting units 1 is not limited, and other quantities of the LED light-emitting units 1 can be used.

As shown in FIG. 1, one embodiment of a decorative LED light string structure comprises a plurality of LED light-emitting units 1, each of the LED light-emitting units 1 comprises an RGB light-emitting diode 1*a* with one common pin and three electrode pins, the common pin is positive and three electrode pins are negative, and a control IC 1*b* capable of storing an address code and capable of comparing address code signals. The control IC 1*b* comprises a positive power terminal, a negative power terminal, a write terminal capable of writing address code information, and three control terminals capable of controlling illumination. The common pin of the RGB light-emitting diode 1*a* is connected to the positive power terminal of the control IC 1*b*, and the three electrode pins of the RGB light-emitting diode 1*a* are respectively connected to the three control terminals of the control IC 1*b* correspondingly.

One embodiment of one of the electrode pins of the RGB light-emitting diode 1*a* is connected with a voltage amplifier circuit 3, and an output terminal of the voltage amplifier circuit 3 is connected to the write terminal of the control IC 1*b*. The LED light-emitting units 1 are connected in series or in parallel through the positive power terminals and the negative power terminals of the control ICs 1*b*, and series connection is adopted in this embodiment.

One embodiment of a resistor R1 capable of forming a voltage signal is disposed between the voltage amplifier circuit 3 and the electrode pin of the RGB light-emitting diode 1*a* connected to the voltage amplifier circuit 3, one end of the resistor R1 is connected to an input terminal of the voltage amplifier circuit 3, and another end of the resistor R1 is connected to the aforementioned electrode pin of the RGB light-emitting diode 1*a*.

One embodiment of the packaged RGB light-emitting diode 1*a* is composed of an R light-emitting diode emitting red light, a G light-emitting diode emitting green light, and a B light-emitting diode emitting blue light, a positive terminal of the R light-emitting diode, a positive terminal of the G light-emitting diode, and a positive terminal of the B light-emitting diode are connected to form the common pin of the RGB light-emitting diode 1*a*, the common pin is connected with a resistor R2 capable of current limiting, and the positive power terminal of the control IC 1*b* is connected to the common pin of the RGB light-emitting diode 1*a* through the resistor R2.

One embodiment of the LED light-emitting units 1 are sequentially arranged, the negative power terminal of the control IC 1*b* of the first LED light-emitting unit 1 is connected to the positive power terminal of the control IC 1*b* of the second LED light-emitting unit 1 to form the LED light-emitting units 1 connected in series, and a voltage regulation module is connected between the positive power terminal in the control IC 1*b* and the negative power terminal of the same control IC 1*b*. The voltage regulation module comprises a voltage regulator diode D2 and a resistor R3. A positive terminal of the voltage regulator diode D2 is connected to the negative power terminal of the corresponding control IC 1*b*, and a negative terminal of the voltage regulator diode D2 is connected to the positive power terminal of the control IC 1*b*. The resistor R3 is connected in parallel with the voltage regulator diode D2.

One embodiment of the decorative LED light string structure further comprises a power supply unit, an electronic switch 4, and a main controller 5 capable of controlling an on-off frequency of the electronic switch 4, the electronic switch 4 is respectively connected to the power supply unit and the main controller 5, the positive power terminal of the control IC 1*b* of the first LED light-emitting unit 1 of the LED light-emitting units 1 in series connection is connected to a current output terminal of the electronic switch 4, the negative power terminal of the control IC 1*b* of the last LED light-emitting unit 1 of the LED light-emitting units 1 in series connection is connected to a current input terminal of the electronic switch 4, and a capacitor C1 capable of charging and discharging is connected between the positive power terminal in the control IC 1*b* and the negative power terminal of the same control IC 1*b*. The electronic switch 4 can be a triode or a MOS tube.

One embodiment of the power supply unit comprises a transformer module 6 capable of connecting the mains supply and transforming the mains supply, and a rectifier filter module 7 capable of rectifying and filtering the voltage after the transformation, the rectifier filter module 7 is connected to the transformer module 6, and an output terminal of the rectifier filter module 7 is connected to the electronic switch 4.

Figure 6:
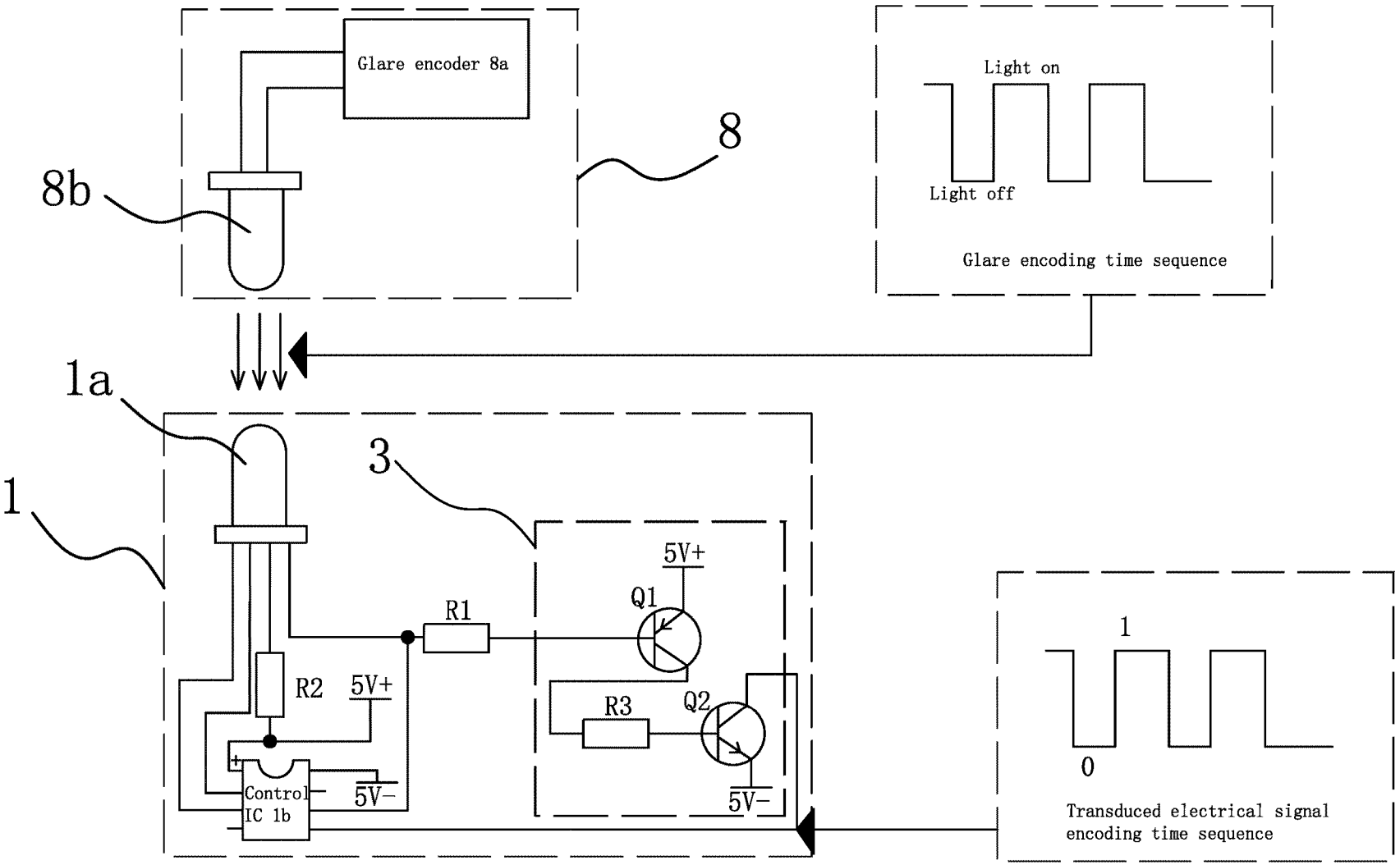
FIG. 6 is a schematic diagram of the process of generating one embodiment of an address code of the present invention.

As shown in FIG. 6, preferably one embodiment of the voltage amplifier circuit 3 comprises a PNP type triode Q1, an NPN type triode Q2, and a resistor R3. A base of the triode Q1 is connected to the resistor R1, a collector of the triode Q1 is connected to one end of the resistor R3, another end of the resistor R3 is connected to a base of the triode Q2, a collector of the triode Q2 is connected to the write terminal of the control IC 1*b*, an emitter of the triode Q1 is connected to the current output terminal of the electronic switch 4, and an emitter of the triode Q2 is connected to the current input terminal of the electronic switch 4. As an alternative, the triode Q1 and the triode Q2 can be replaced with a MOS tube.

One embodiment of the decorative LED light string structure is assembled by the following method, and the specific steps are as follows as shown in FIG. 3 to FIG. 6.

Step A, assembling an LED light string: connecting and assembling a control IC 1*b* not yet encoded with an address code together with an RGB light-emitting diode 1*a*, connecting the common pin of the RGB light-emitting diode 1*a* to the positive power terminal of the control IC 1*b*, connecting the three electrode pins of the RGB light-emitting diode 1*a* respectively to the three control terminals correspondingly, connecting one of the three electrode pins of the RGB light-emitting diode 1*a* to the resistor R1, connecting the resistor R1 to the write terminal of the control IC 1*b* through the voltage amplifier circuit 3, connecting the positive power terminal of the control IC 1*b* to the common pin of the RGB light-emitting diode 1*a* through the resistor R2, packaging the control IC 1*b*, the RGB light-emitting diode 1*a*, the resistor R1, the resistor R2, and the voltage amplifier circuit 3 to form the LED light-emitting unit 1, leading the positive power terminal and the negative power terminal of the control IC 1*b* to the outside of the package, arranging the LED light-emitting units 1 sequentially, connecting the negative power terminal of the control IC 1*b* of the first LED light-emitting unit 1 to the positive power terminal of the control IC 1*b* of the second LED light-emitting unit 1 to form the LED light-emitting units 1 connected in series, and connecting the voltage regulation module and the capacitor C1 between the positive power terminal in the control IC 1*b* and the negative power terminal of the same control IC 1*b*.

Step B, encoding and inputting address code: using a glare encoding device 8 to irradiate the RGB light-emitting diode 1*a* of each of the LED light-emitting units 1 with illumination of different frequencies, and inputting an optical encoding signal. The glare encoding device 8 can adopt a glare encoder 8*a* and an encoding LED 8*b* that is controlled by the glare encoder 8*a* to turn on illumination of different frequencies, and the optical encoding signal is inputted through irradiating the RGB light-emitting diode 1*a* by the encoding LED 8*b*. As an alternative, the glare encoding device 8 adopts a PC and an optical signal transmitter, and the PC controls the optical signal transmitter to input the optical encoding signal into the RGB light-emitting diode 1*a*.

Step C, forming address code: having the RGB light-emitting diode 1*a* generate a corresponding periodical micro current according to the inputted optical encoding signal, having the generated micro current flow through the resistor R1 to generate a voltage signal, amplifying the voltage signal by the voltage amplifier circuit 3 and inputting the amplified voltage signal into the control IC 1*b*, and having the control IC 1*b* generate a corresponding address code according to an intensity and a period of the voltage signal. After the address code is formed, the control IC 1*b* outputs a voltage to control the RGB light-emitting diode 1*a* connected to the control IC 1*b* to turn on a corresponding light.

In the assembly process of one embodiment of the LED light string, the control ICs 1*b* respectively with a blank address code (not yet encoded with an address code) are adopted, so that the control ICs 1*b* are not required to be assembled in the order of the address codes, and there is no need to find the corresponding RGB light-emitting diodes 1*a*, and therefore the operator can arbitrarily select the address code and the RGB light-emitting diode 1*a* for assembly, thereby greatly improving the assembly efficiency of the LED light-emitting units 1. Only the positive power terminals and the negative power terminals of the control ICs 1*b* of the LED light-emitting units 1 are led outside of the package, and the LED light-emitting units 1 can be quickly connected to each other to form the LED light string to further enhance the assembly efficiency. After completing the assembly of the LED light string, the optical encoding signals are inputted into the RGB light-emitting diodes 1*a* by using the glare encoding device 8. By disposing the voltage amplifier circuit 3, the control ICs 1*b* in the LED light string can sense the optical encoding signals received by the RGB light-emitting diodes 1*a*, thereby the address codes can be inputted quickly; and by disposing the voltage amplifier circuit 3, assembly of the LED string without first writing the address code is an ensured success.

In one embodiment of the LED light string completed with encoding, the main controller 5 controls the on-off frequency of the electronic switch 4 so that the electronic switch 4 outputs different electrical signals to the respective control ICs 1*b*, thereby addressing the address codes of the control ICs 1*b*. When the electronic switch 4 is in a conducting state, the capacitor C1 is charged, and the capacitor C1 is discharged to supply electric power for the control IC 1*b* when the electronic switch 4 is disconnected, thereby the control IC 1*b* can be powered continuously to operate when the main controller 5 controls the electronic switch 4 to be turned on and off.

Embodiment 2

Figure 2:
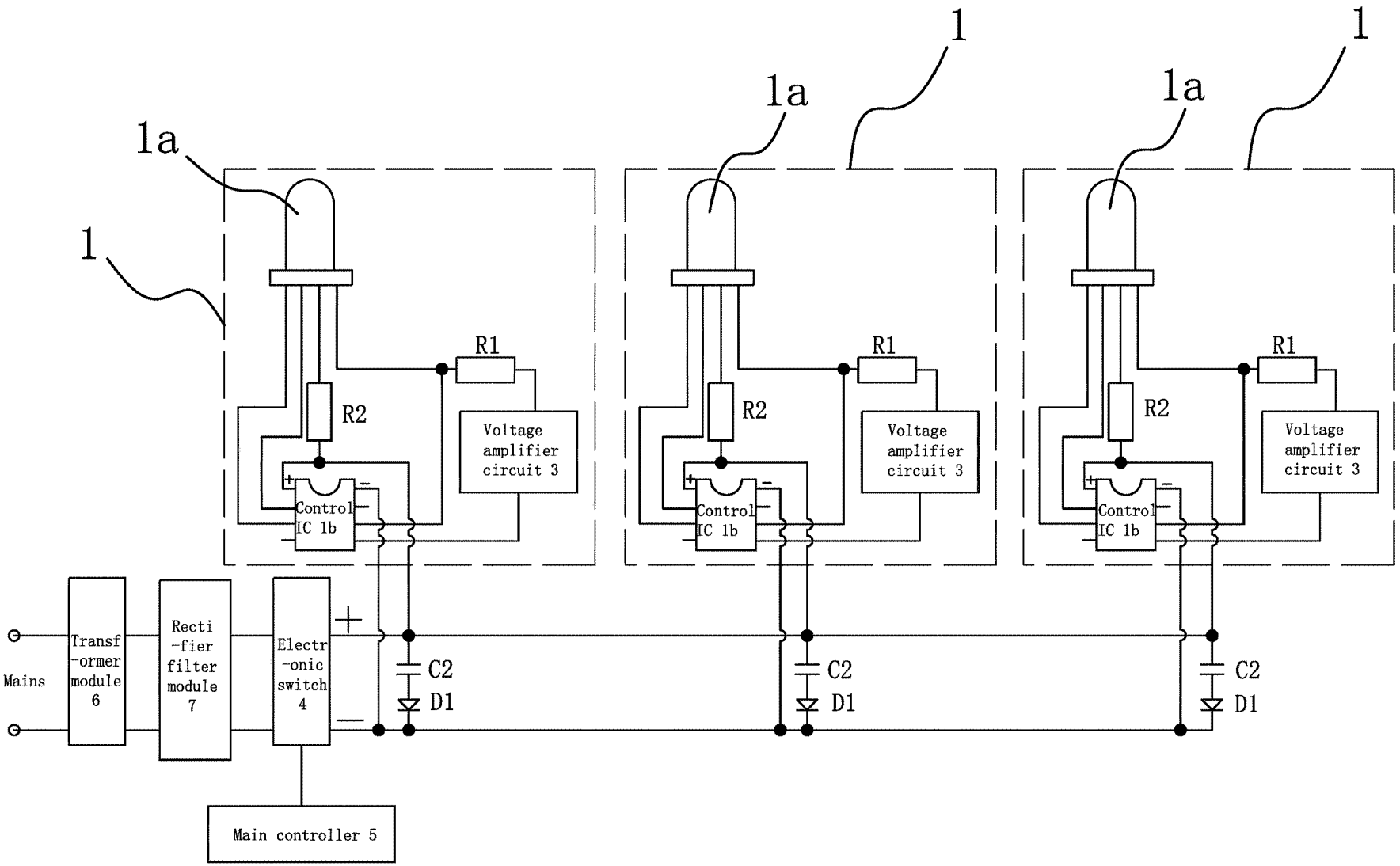
FIG. 2 is a schematic diagram of the structure of one embodiment of the LED light string formed by connecting the LED light-emitting units of the present invention in parallel.
Figure 3:
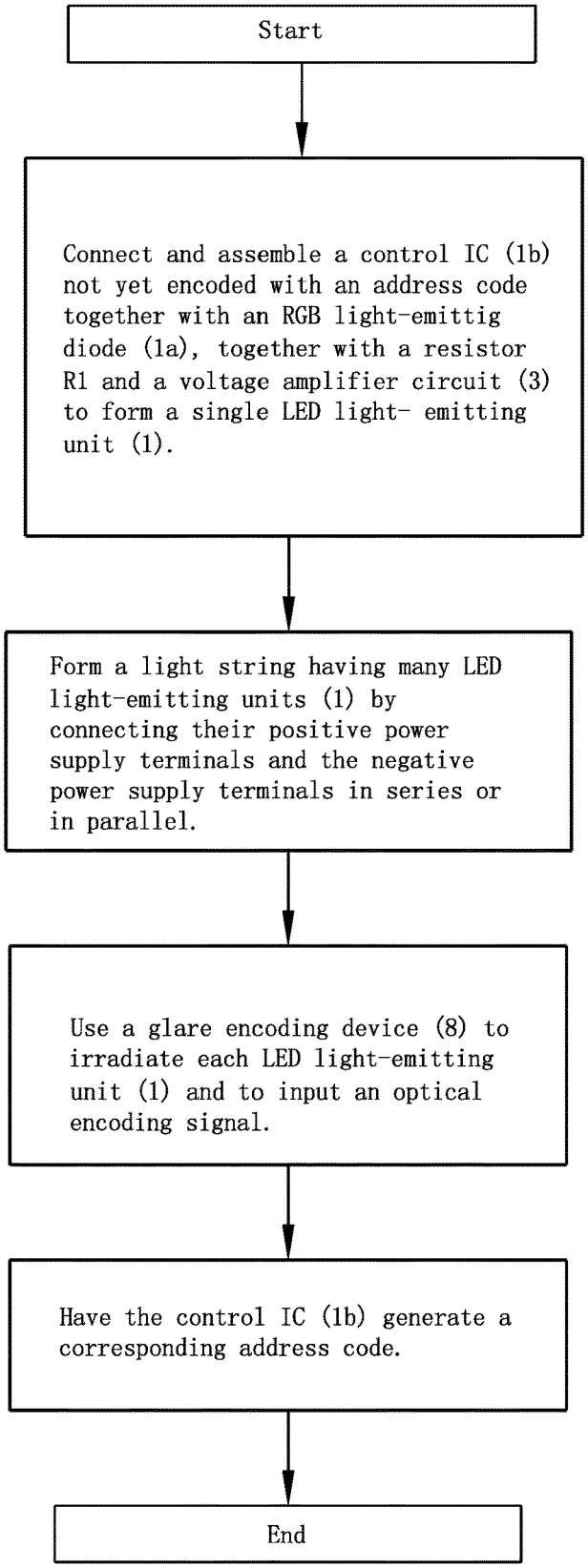
FIG. 3 is a flow diagram of one embodiment of a method for assembling a decorative LED light string of the present invention.
Figure 4:
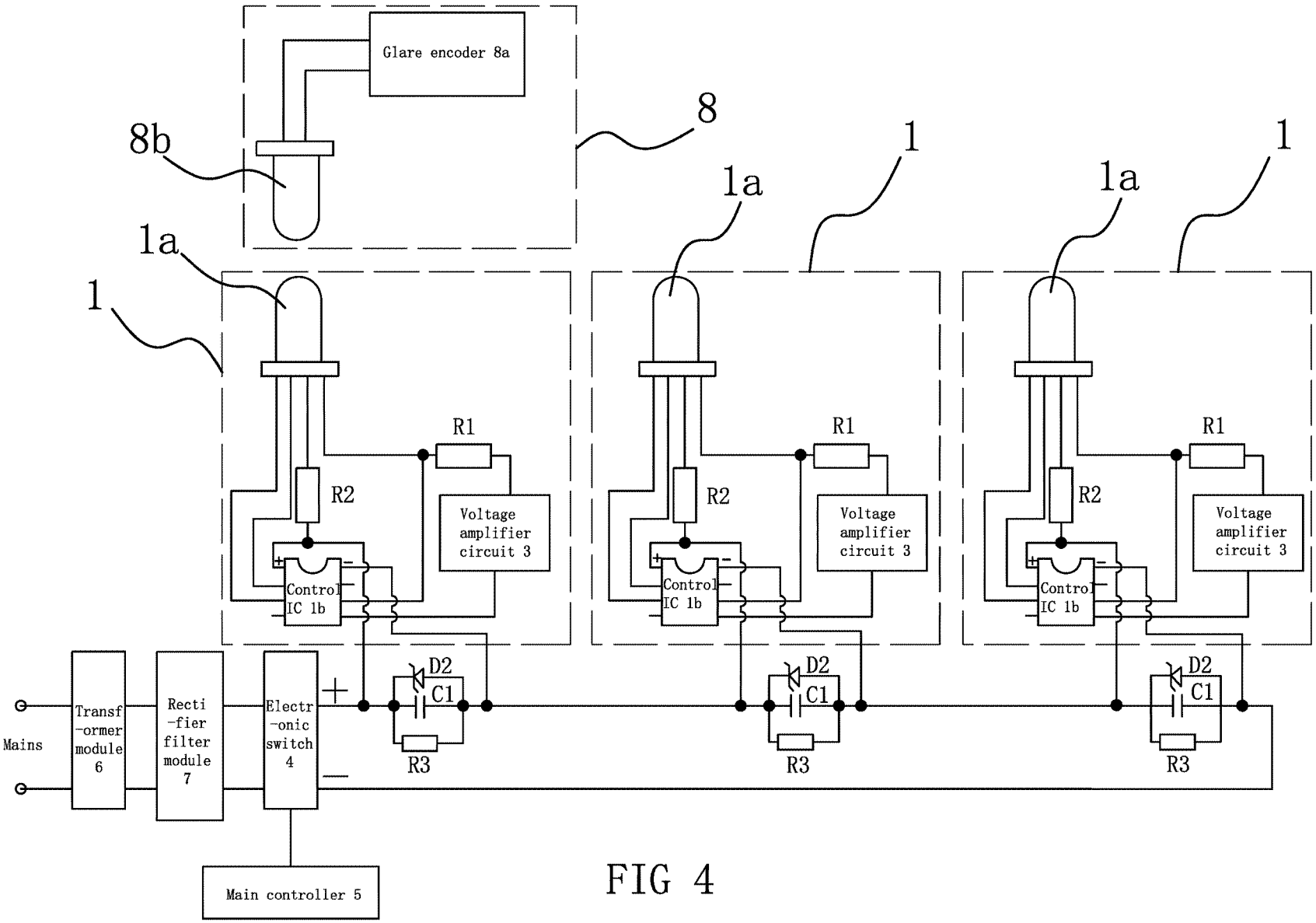
FIG. 4 is a first schematic diagram of encoding one embodiment of the LED light-emitting units by a glare encoding device of the present invention.
Figure 5:
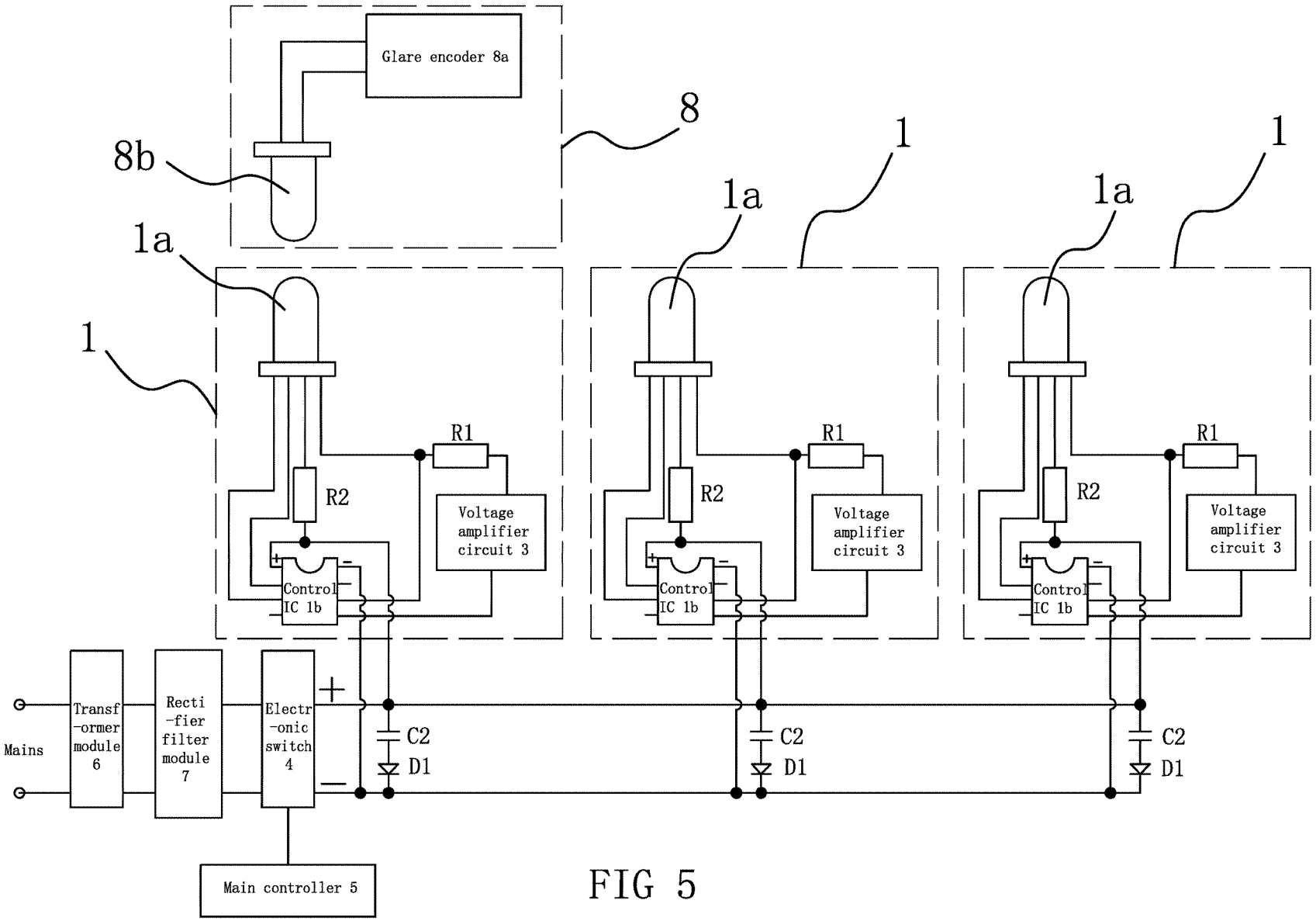
FIG. 5 is a second schematic diagram of encoding one embodiment of the LED light-emitting units by the glare encoding device of the present invention.

As shown in FIG. 2, only three LED light-emitting units 1 are used as an example, a quantity of LED light-emitting units 1 is not limited, and other quantities of the LED light-emitting units 1 can be used. The second embodiment has the same structure and principles as those of the first embodiment, and the differences are that: the LED light-emitting units 1 are sequentially arranged, the positive power terminal of the control IC 1*b* of each of the LED light-emitting units 1 are connected to each other, and the negative power terminal of the control IC 1*b* of each of the LED light-emitting units 1 are connected to each other to form the LED light-emitting units 1 connected in parallel; the positive power terminal of the control IC 1*b* of each of the LED light-emitting units 1 of the LED light-emitting units 1 in parallel connection is connected to the current output terminal of the electronic switch 4, the negative power terminal of the control IC 1*b* of each of the LED light-emitting units 1 of the LED light-emitting units 1 in parallel connection is connected to the current input terminal of the electronic switch 4, the positive power terminal of each of the control ICs 1*b* is connected with a diode D1 and a capacitor C2 capable of charging and discharging, one end of the capacitor C2 is respectively connected to the current output terminal of the electronic switch 4 and the positive power terminal of the corresponding control IC 1*b*, and another end of the capacitor C2 is connected to a positive terminal of the diode D1, and a negative terminal of the diode D1 is connected to the current input terminal of the electronic switch 4.

The main controller 5 controls the on-off frequency of the electronic switch 4 so that the electronic switch 4 outputs different electrical signals to the respective control ICs 1*b*, thereby addressing the address codes of the control ICs 1*b*. When the electronic switch 4 is in a conducting state, the capacitor C2 is charged, and the capacitor C2 is discharged to supply electric power for the control IC 1*b* when the electronic switch 4 is disconnected, thereby the control IC 1*b* can be powered continuously to operate when the main controller 5 controls the electronic switch 4 to be turned on and off, and the capacitor C2 is ensured to discharge normally by disposing the diode D1.

The specific embodiments described herein are merely illustrative of the spirit of the present invention. Technical personnel skilled in the art to which the present invention pertains can make various modifications or additions to the specific embodiments described or replace them in a similar manner, without departing from the spirit of the present invention or beyond the scope defined by the appended claims.

Although the technical terms LED light-emitting unit 1, RGB light-emitting diode 1*a*, control IC 1*b*, voltage amplifier circuit 3, electronic switch 4, main controller 5, transformer module 6, rectifier filter module 7, glare encoding device 8, glare encoder 8*a*, encoding LED 8*b*, and the like are used more frequently herein, the possibility of using other technical terms is not excluded. These technical terms are merely used to describe and explain the nature of the present invention more conveniently; construing them as any additional limitation is contrary to the spirit of the present invention.

LIST OF REFERENCED PARTS

1 LED light-emitting unit
1*a* RGB light-emitting diode
1*b* control IC
3 voltage amplifier circuit
4 electronic switch
5 main controller
6 transformer module

7 rectifier filter module
8 glare encoding device
8*a* glare encoder
8*b* encoding LED

What is claimed is:

1. A method for assembling a decorative LED light string comprising the following steps:

A. assembling an LED light string: connecting and assembling a control IC not yet encoded with an address code together with an RGB light-emitting diode, connecting an electrode pin of the RGB light-emitting diode with a voltage amplifier circuit, connecting an output terminal of the voltage amplifier circuit with a write terminal of the control IC, packaging the control IC, the RGB light-emitting diode, and the voltage amplifier circuit to form a first LED light-emitting unit, and connecting a plurality of LED light-emitting units in series or in parallel to form the LED light string;

B. encoding and inputting address code: using a glare encoding device to irradiate the RGB light-emitting diode of each of the LED light-emitting units with illumination of different frequencies, and inputting an optical encoding signal; and C. forming address code: having the RGB light-emitting diode generate a corresponding periodical micro current according to the inputted optical encoding signal, having the generated micro current flow through a resistor R1 to generate a voltage signal, amplifying the voltage signal by the voltage amplifier circuit and inputting an amplified voltage signal into the control IC, and having the control IC generate a corresponding address code according to a period of the voltage signal.

2. The method for assembling the decorative LED light string as claimed in claim 1, wherein in step C, after the address code is formed, the control IC outputs a voltage to control the connected RGB light-emitting diode to turn on a corresponding light.

3. The method for assembling the decorative LED light string as claimed in claim 1, wherein the glare encoding device comprises a glare encoder and an encoding LED that is controlled by the glare encoder to turn on illumination of different frequencies, and the optical encoding signal is inputted through irradiating the RGB light-emitting diode by the encoding LED.

* * * * *